United States Patent [19]

Erickson

[11] 4,278,399

[45] Jul. 14, 1981

[54] PUMPING STAGE FOR MULTI-STAGE CENTRIFUGAL PUMP

[75] Inventor: John W. Erickson, Huntington Beach, Calif.

[73] Assignee: Kobe, Inc., City of Commerce, Calif.

[21] Appl. No.: 50,915

[22] Filed: Jun. 21, 1979

[51] Int. Cl.[3] ..... F04D 1/06; F04D 13/10; F04D 29/24

[52] U.S. Cl. ..... 415/199.1; 415/213 R; 415/501; 416/186 R

[58] Field of Search ..... 415/199.1, 199.2, 199.3, 415/501, 213 R, 193; 416/186 R

[56] References Cited

U.S. PATENT DOCUMENTS

| | | | |
|---|---|---|---|
| 1,974,107 | 9/1934 | Hait | 415/501 X |
| 2,978,989 | 4/1961 | Lung | 415/199.3 X |
| 3,250,458 | 5/1966 | Caldwell | 415/199.2 X |
| 3,265,001 | 8/1966 | Deters | 415/501 X |
| 3,807,894 | 4/1974 | O'Rourke | 415/199.2 X |

FOREIGN PATENT DOCUMENTS

| | | | |
|---|---|---|---|
| 906894 | 8/1956 | Fed. Rep. of Germany | 415/199.3 |
| 827590 | 2/1960 | United Kingdom | 415/501 |

*Primary Examiner*—Leonard E. Smith
*Attorney, Agent, or Firm*—William C. Norvell, Jr.

[57] ABSTRACT

An improved diffusion bowl and pumping vanes of a centrifugal pump stage are employed in axially stacked, multi-stage pumps for use in oil wells. The wall thickness of the annular casing portion of the diffusion bowl element is reduced to a minimum consistent with the axial loading on the pump stage and the impeller vanes are radially extended to terminate closely adjacent the minimum wall thickness portion of the casing, thereby significantly increasing the pumping pressure developed by the stage without reducing the efficiency of the stage.

2 Claims, 3 Drawing Figures

PUMPING STAGE FOR MULTI-STAGE CENTRIFUGAL PUMP

BACKGROUND OF THE INVENTION

1. Field of the Invention

This invention relates to an improved design for a centrifugal pumping stage of a multi-stage, axially stacked, centrifugal pump of the type employed in oil wells.

2. Description of the Prior Art

As oil wells are drilled and completed to increased depths for production, the pumping requirements, particularly the pressure head to be developed by the pumping apparatus, have increased in more than direct proportion to the well depth. A conventional form of pump employed for pumping fluid from deep oil wells is the multi-stage centrifugal pump wherein a plurality of pumping stages are axially stacked, one upon the other, and driven by a common shaft. Since the diameter of the pumping apparatus is positively limited by the internal diameter of the well casing, and the motor speed is limited to less than 3600 RPM, if 60 cycle current is employed, it has heretofore been only possible to increase the effective pressure head developed by the electric motor driven multi-stage pump by adding additional pumping stages.

In addition to the diametrical constraint imposed by the interior diameter of the well casing, there must also be recognized the fact that the electric power supply to the pump motor must be carried down through the casing and, even though this may represent a cable having a diameter of one-half inch or less, this further reduces the size of the exterior dimensions of the housing for the pumping stages that can be inserted in the casing. The wall thickness of the cylindrical housing for the multi-stage pumping apparatus obviously is determined by the very substantial tensile forces exerted on such housing when the entire assembly of one hundred or more stages is incorporated within the housing and lowered into position in the well. These restraints thus produce an unchangeable maximum diameter within the multi-stage pump housing in which the pumping elements must operate.

In many oil fields, pumping stages on the order of two hundred to three hundred units are often required to develop the required pressure head. A modest increase in pressure developed by each stage of such multi-stage pumps could therefore effect a significant reduction in the number of stages required. For example, a ten percent increase in pumping head per stage in a two hundred stage pump would result in a reduction of a number of pumping stages required by twenty. If such pressure increase could be accomplished with no decrease in efficiency, the substantial cost savings would be self-evident.

SUMMARY OF THE INVENTION

This invention provides an improved design configuration of a centrifugal pumping stage for an axially stacked, multi-stage centrifugal pumping apparatus. In particular, the invention reduces the thickness of the casing portion of the stationary diffusion bowl of each pumping stage to a minimum consistent with the strength required in such casing portion to resist the axial stacking forces, and concurrently increases the effective diameter of the pumping vanes of the rotor of each stage so that such vanes terminate closely adjacent to the inner wall of the minimum thickness casing portion. In a modification of this invention, a chamfer is provided on the extreme ends of the rotor blades to impart an axial motion to the fluid being pumped.

Accordingly, it is a feature of this invention to provide an improved pumping stage for a multi-stage, axially stacked centrifugal pumping apparatus for oil wells.

Other objects and advantages of the invention will be apparent to those skilled in the art from the following detailed description.

DESCRIPTION OF THE PREFERRED EMBODIMENTS

Figure 1:
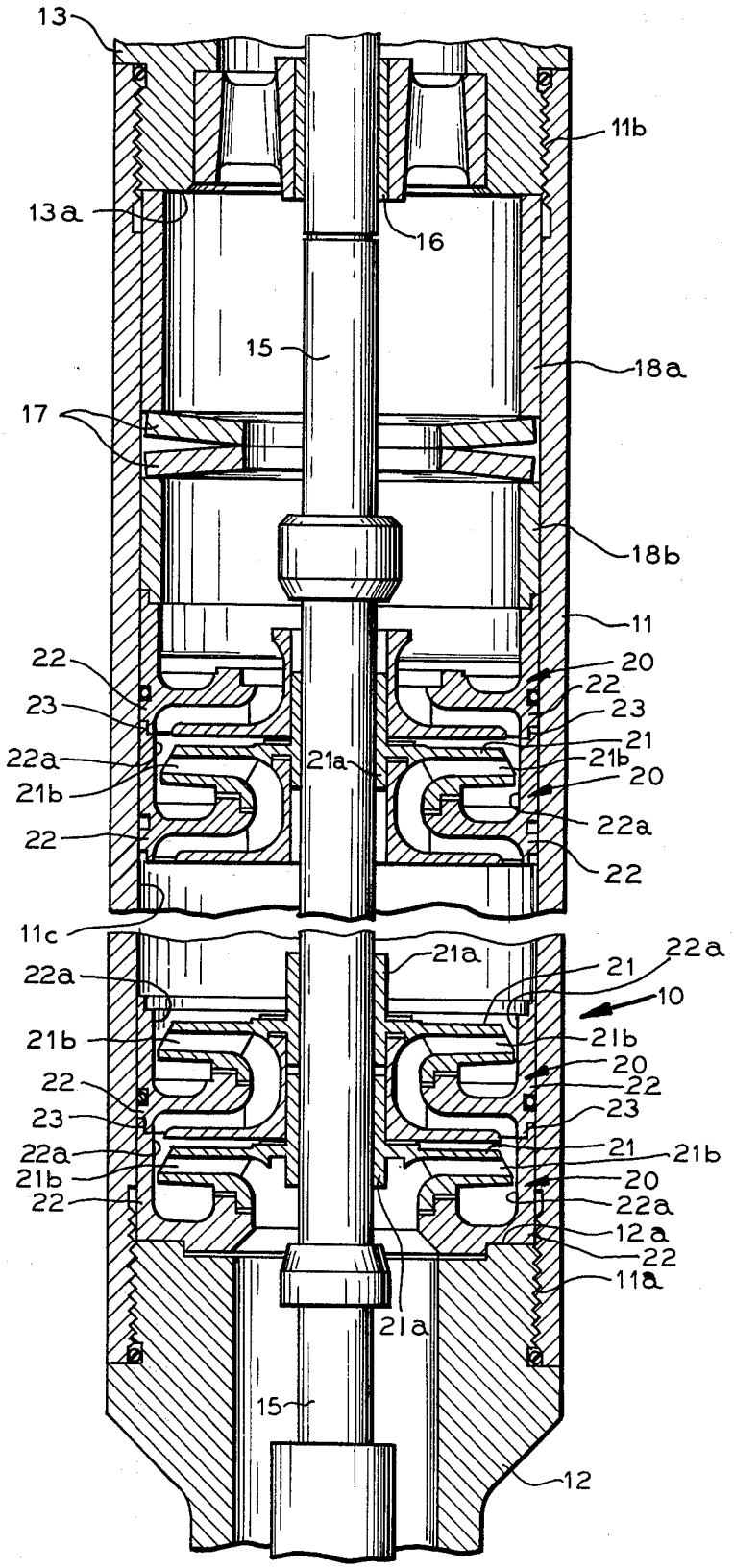
FIG. 1 PRIOR ART
FIG. 1 is a schematic sectional view of a conventional axially stacked, multi-stage centrifugal pump of the type currently employed in oil wells.

In FIG. 1, the numeral 10 indicates a conventional multi-stage centrifugal pump of the type employed in pumping oil wells. Such pump comprises a cylindrical housing 11 having a lower threaded portion **11*a* threaded onto an annular connecting block 12 from which the driving motor for the pump is suspended. At its top end, the housing 11 is provided with a threaded connection 11*b* to a spacer block 13** which defines connections to the production casing leading to the top of the well.

A power shaft 15 extends centrally through the housing 11 and is supported therein by a number of journal-type bearings 16, of which only one is shown, being mounted in the central portion of the upper spacer block 13. Between a top face **12*a* of the lower block 12 and a bottom face 13*a* of the upper block 13, a chamber is defined within which a plurality of pumping stages 20 are disposed in axially stacked relationship. The axial clamping force imparted to the stack of pumping stages 20 is determined by a pair of spring washers 17 which are disposed between spacer sleeves 18*a* and 18*b***.

Each pumping stage 20 includes an impeller portion 21 which has a central hub **21*a* which is suitably secured to the drive shaft 15 for co-rotation and radial impeller vanes 21*b* which cooperate with an annular stator or diffusion bowl unit 22 which is snugly engaged with an interior surface 11*c* of the cylindrical housing 11. The junction between each successive diffusion bowl 22 is defined by an overlapped joint indicated at 23. Since a tip of each vane portion 21*b* of impeller 21 passes in close proximity to the interior surface of an adjacent annular portion 22*a* of the cooperating bowl unit 22, it is readily apparent that the maximum diameter of each vane is determined by the interior diameter of the overlapped joint portion 23** of the adjacent stators.

It is observed that with this conventional construction, the stator or diffusion bowl units 22 are more than adequately supported against all centrifugal or outwardly directed forces by being snugly mounted within the bore **11*c* of the housing 11. It necessarily follows that the only forces that the overlapped joint 23 of the adjacent stator elements are resisting is the axial compression forces exerted on the stack by the spring washers 17**.

Figure 2:
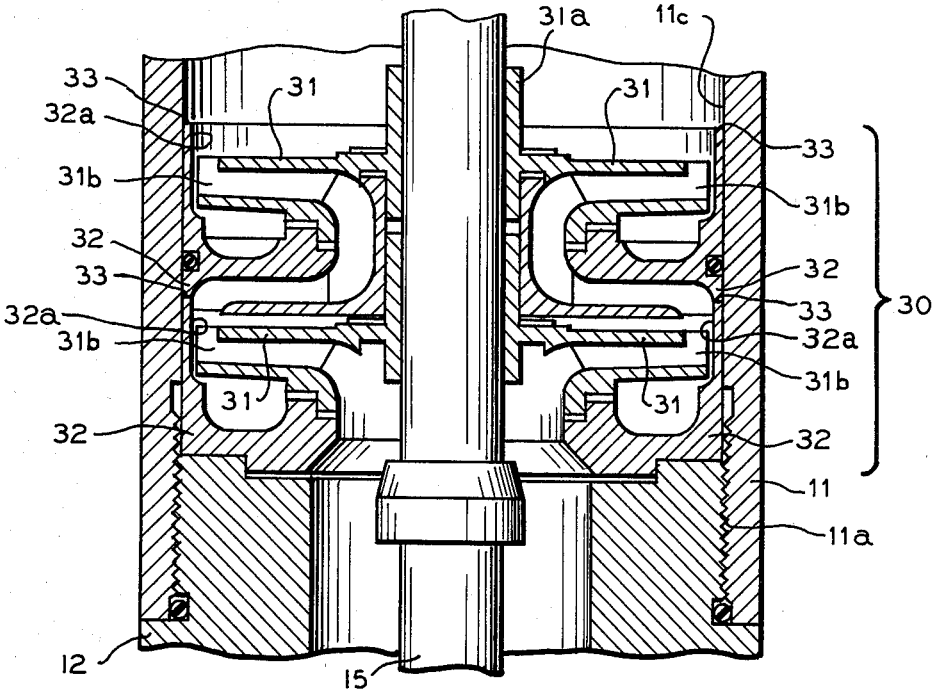
FIG. 2 is a view similar to FIG. 1 of an individual pumping stage which has been modified in configuration in accordance with this invention.

Referring now to FIG. 2, there is shown a portion of an axially stacked, multi-staged centrifugal pump constructed in accordance with this invention for use in deep wells. As in the case of the pump shown in FIG. 1, the axial stack of pump stages 30 is disposed within a cylindrical housing 11 having a threaded engagement 11*a* with a lower connecting block 12 and an upper spacer block (not shown) in the same manner as illustrated in FIG. 1. The axial clamping force on the stacked stages is produced by the same spring washer arrangement previously described in connection with FIG. 1.

The interior diameter 11*c* of the housing 11 is made as large as permitted by the well casing and the structural strength requirements of the housing 11 in supporting the many pumping stages and the driving motor.

Each pumping stage 30 comprises a pump impeller portion or rotor 31 of generally conventional configuration which is keyed or otherwise suitably secured to the power shaft 15 for co-rotation by a central hub 31*a*. Each impeller 31 cooperates with a stator or diffusion bowl member 32 and the successive bowl members are disposed in axially stacked relationship. However, the juncture between the bowl members is now defined by a butt joint 33 between annular portions 32*a* which are proportioned to be strong enough to only withstand the axial clamping forces exerted upon the stack of pump stages.

The employment of a single thickness butt joint between the successive diffusion bowls 32 inherently permits the radius of the impeller vanes 31*b* to be significantly increased, in most cases, an increase sufficient to produce an increase in pumping pressure on the order of from ten percent to twenty percent. With each stage producing a minimum of ten percent more pumping pressure, it is apparent that the total number of stages required to pump a deep well can be reduced by a factor of ten percent and that the total cost of pumping equipment for such wells is reduced in the same proportion.

Figure 3:
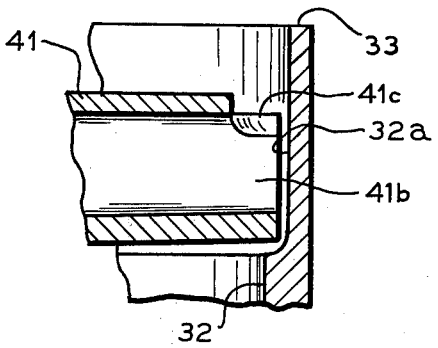
FIG. 3 is an enlarged scale partial view of a pump impeller tip illustrating a modification of this invention.

Referring now to FIG. 3, there is shown a further modification of this invention wherein the edge of the outer extremity of an impeller vane 41*b* of an impeller portion 41 is chamfered as indicated at 41*c* in order to produce an axial component of movement to the fluid being pumped. The provision of this chamfer has been found to produce a further increase in effective pumping head developed by each of the centrifugal pumping stages.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A centrifugal pump stage for a multi-stage oil well pump wherein all stages are driven by a common shaft and are axially stacked upon each other and axially clamped together within a fixed diameter cylindrical housing insertable within a well casing, comprising, in combination: a pump impeller securable to said shaft and having generally radially extending vanes; an annular diffusion bowl adjacent said impeller, said bowl having an annular casing portion snugly fitting within the housing wall and surrounding the impeller vanes, the radial thickness of said annular casing portion supporting the effective axial load imposed on the pump stage, said vanes extending radially to terminate closely adjacent the inner wall of said annular casing portion, whereby the pressure developed by the pump stage is maximized, the radially outermost portion of each of said vanes be chamfered in a direction to impart an axial force on the fluid being pumped.

2. A multi-stage oil well pump, comprising: a cylindrical housing of maximum diameter permitting insertion with a well casing; a motor driven shaft concentrically disposed in said housing; a plurality of annular pumping stages surrounding said shaft and disposed in axially stacked relationship, each stage comprising a pump impeller secured to said shaft for co-rotation and an adjacent stationary annular diffusion bowl, each pump impeller having radially extending vanes thereon, each bowl having an annular casing portion surrounding the impeller vanes and contacting the adjacent diffusion bowl, each said casing portion snugly engaging the interior wall of said housing, means in said housing for producing an axial clamping force on said stack of diffusion bowls, the radial thickness of said annular casing portion supporting the effective axial load imposed on the pump stage, said vanes extending radially to terminate closely adjacent the inner wall of said annular casing portion, whereby the pressure developed by each pump stage is maximized, the radially outermost portion of each of the said vanes being chamfered in a direction to impart an axial force on the fluid being pumped.

* * * * *